US009421423B2

(12) United States Patent
Umemura et al.

(10) Patent No.: US 9,421,423 B2
(45) Date of Patent: Aug. 23, 2016

(54) NON-CIRCULAR DIMPLE GOLF BALL

(75) Inventors: Sunao Umemura, Akashi (JP); Mitsuhiro Saso, Himeji (JP)

(73) Assignee: HANABI CO., LTD., Hyogo (JP)

( * ) Notice: Subject to any disclaimer, the term of this patent is extended or adjusted under 35 U.S.C. 154(b) by 294 days.

(21) Appl. No.: 13/993,845

(22) PCT Filed: Dec. 14, 2011

(86) PCT No.: PCT/JP2011/078854

§ 371 (c)(1),
(2), (4) Date: Jun. 13, 2013

(87) PCT Pub. No.: WO2012/081594

PCT Pub. Date: Jun. 21, 2012

(65) Prior Publication Data

US 2013/0267349 A1 Oct. 10, 2013

(30) Foreign Application Priority Data

Dec. 15, 2010 (JP) ..... 2010-279934

(51) Int. Cl.
*A63B 37/06* (2006.01)
*A63B 37/00* (2006.01)

(52) U.S. Cl.
CPC ..... *A63B 37/002* (2013.01); *A63B 37/0004* (2013.01); *A63B 37/0006* (2013.01); *A63B 37/0007* (2013.01); *A63B 37/0008* (2013.01)

(58) Field of Classification Search
CPC ..... A63B 37/0008
USPC ..... 473/378–385
See application file for complete search history.

(56) References Cited

U.S. PATENT DOCUMENTS

| | | | | |
|---|---|---|---|---|
| 4,830,378 | A | 5/1989 | Aoyama | |
| 4,869,512 | A * | 9/1989 | Nomura | A63B 37/0004 473/383 |
| 5,503,398 | A * | 4/1996 | Lu | A63B 37/0004 473/384 |
| 5,722,903 | A * | 3/1998 | Moriyama | A63B 37/0004 40/327 |
| 6,475,105 | B1 * | 11/2002 | Murphy | A63B 37/0004 473/378 |
| 7,559,857 | B2 * | 7/2009 | Sato | A63B 37/0007 473/383 |
| 2015/0057106 | A1 * | 2/2015 | Kishishita | A63B 37/0006 473/384 |

FOREIGN PATENT DOCUMENTS

| | | |
|---|---|---|
| JP | 64-8982 | 1/1989 |
| JP | 6-190082 | 7/1994 |
| JP | 2003-169861 | 6/2003 |
| JP | 2005-185341 | 7/2005 |
| JP | 3147277 | 12/2008 |

OTHER PUBLICATIONS

International Search Report issued Mar. 19, 2012 in corresponding International Application No. PCT/JP2011/078854.

* cited by examiner

*Primary Examiner* — Raeann Gorden

(74) *Attorney, Agent, or Firm* — Wenderoth, Lind & Ponack, L.L.P.

(57) ABSTRACT

Non-circular dimples such as oval form dimples are provided on the spherical surface of a ball body. A golf ball includes a spherical land surface of the ball body and a dimple pattern of a plurality of dimples formed on the spherical land surface, the spherical surface of the ball body being divided into a plurality of spherical surface parts (land surfaces) with each polygon faces of polyhedron which is virtually inscribed in said spherical surface of ball body, by a projection method from each polygon faces of the inscribed polyhedron, on each spherical surface parts some or all of the dimples being formed as non-circular dimple having a width of more than 1.5 mm and a length of more than 2 times of the width and the dimple pattern is disposed so as to make vortices generated in the non-circular dimples flow out in at least two different directions.

9 Claims, 17 Drawing Sheets

(a)

(b)

(c)

NON-CIRCULAR DIMPLE GOLF BALL

TECHNICAL FIELD

This invention relates to a golf ball provided with a dimple pattern comprising non-circular dimples for improving a driving aerodynamics property.

BACKGROUND ART

Conventionally, it has been widely recognized in golf players that, as a good condition for a ball driving action within a speed range of 20 to 70 m/sec, a golf ball had better be provided with circular dimples on the surface in comparison with no dimples because the dimples make the driving drag smaller and also make the driving distance longer than that with no dimples if the same ball initial velocity is given. Further, it has been also recognized that a bigger circular dimple is preferred at a lower driving velocity for a golf ball while a smaller circular dimple is preferred at a higher driving velocity for a golf ball.

Therefore, recently in order to increase the lift-drag ratio (lift/drag) which affects the driving distance, a lot of research has been done for testing a dimple pattern, a peripheral form of dimple and a cross-section of dimple. For example, there were proposed a concept of triangular dimples and their dimple pattern (PTL 1), a concept of section ally cone-shaped dimples provided with triangular periphery (PTL 2) and a concept of polygonal dimples provided with ridges between dimples (PTL 3).

In other words, it has been well known to the golf players that the dimples are necessary to increase the lift-drag ratio and some land areas on the golf ball surface and some ridges between dimples are also necessary to increase the lift-drag ratio.

On the other hand, in order to get the official approval according to R&A rules it is requested that the balls should follow the standards concerning the ball weight, the ball size, the initial velocity, the symmetric property and so on. Among the R &A standards, especially the reflection coefficient is strictly circumscribed to a specific range because it has a huge effect on the initial velocity and then the driving distance. Therefore, multi-piece balls such as three or four-piece balls have been proposed and some new materials have been improved in order to obtain a longer driving distance within the standard range of the reflection coefficient according to R&A rules.

PRIOR ART DOCUMENTS

Patent Documents

{PTL 1} U.S. Pat. No. 4,830,378
{PTL 2} Japanese Unexamined Patent Application Publication H06-190082
{PTL 3} Japanese Unexamined Patent Application Publication 2005-185341

SUMMARY OF INVENTION

Technical Problem

However, from the beginning of a circular dimple pattern in golf play history, although number of piece layers of golf balls such as three-piece or four-piece ball as well as the dimple number and the ball size have been studied much, any advanced theories and results concerning the aerodynamics of the golf ball have been hardly obtained as long as the circular dimples are provided. We have researched the above items from a different aspect of the aerodynamics and have found new knowledge against the conventional concept based on the circular dimples. That is, although the circular dimples are necessary to increase the lift power and decrease the drag power, there have been found limitations to move the separating boundary layer to back a little further. This is caused by the phenomenon that longitudinal or vertical vortices generated in the circular dimple tend to flow in a same one direction as long as the circular dimples are provided, so that some of vortices still remain in the circular dimple, resulting in that the separating boundary layer surrounding the driving ball still remains at a smaller one, at max 105°, which means that the angle of the separating boundary layer becomes 110° at the upper side and 105° at the lower side as shown in FIG. 1 (*a*) if the ball rotation is taken into account.

Therefore, a first object of the present invention is to provide a golf ball having a property to increase the lift-drag ratio (lift/drag) for a longer driving even if the spin number would become larger. Further a second object of the present invention is to provide a golf ball having a superior straight driving property.

Solution to Problem

As a result of our research in order to solve the problem described above, we have found from our experiments and our considerations concerning the aerodynamics of the golf ball that the conventional concept based on the circular dimples is not necessarily correct. In other words, when a golf ball is driving with rotating in the air, the separating boundary layer is existing in the vicinity of the maximum vertical width or diameter of the golf ball and then it induces vortices to generate at the back side of the golf ball which leads to the drag action, so that the drag action is greatly affected by the up-down width of separating boundary layer. According to the conventional concept, 1) the circular dimples should be formed to move the separating boundary position back so as to decrease the up-down width of separating boundary layer and then decrease the drag action power. Further, 2) the circular dimples should be formed to obtain the lift power by the speed difference of airflow at the up and down side of the golf ball. Contrary to common sense, however, it has been discovered that, although generation of the vortices in the dimple is never avoided, a golf ball if not provided with dimples, cannot get a sufficient lift action even though the drag can be much decreased, so that a longer driving distance cannot be obtained. That means, that although dimples are necessary to obtain the lift action and the circular dimples must be better than no dimples, but the circular dimples must not be best to decrease the drag power.

Accordingly the present invention is based on the new concept of aerodynamics and is to provide a golf ball, which comprises a spherical land surface of ball body and a dimple pattern comprising a plurality of dimples formed on the spherical land surface, wherein said spherical land surface is divided into a plurality of spherical land surface parts with each polygon face of a polyhedron which is virtually inscribed in said spherical surface of ball body (each spherical land surface part corresponding to each spherical face projected from each polygon face of the inscribed polyhedron to the spherical ball body), on each spherical land surface part some or all of said dimples being formed as non-circular dimples having a width of more than 1.5 mm and a length of more than 2 times of the width and the dimple pattern is disposed so as to make vortices generated in the non-circular dimples flow out in at least two different directions.

In the present invention, it is observed that, since a non-circular dimple has a width of more than 1.5 mm and a length of more than 2 times of the width, the longitudinal or vertical vortices generate respectively with a time difference at the periphery of the non-circular dimples and flow out along the periphery of the non-circular dimples in a different direction, resulting in that the separating boundary layer becomes set back by 5 degree of angle in comparison with the conventional circular dimples as shown in FIG. 1 (B) and thereby the drag power or action would decrease and the driving distance would become longer under the given conditions of the same initial velocity or the same reflection coefficient of the ball. It would be caused by the phenomenon that, although the longitudinal vortices created by the airflow at the periphery of the dimples is not avoided, the vortices flow out along the periphery of the non-circular dimple formed in at least two different directions. The flowing out direction of the vortices is not constant in case of non-circular dimple even if the ball would be driving in a constant direction while the flowing out direction is constant in case of circular dimple, so that the vortices generated at the non-circular dimples tend to flow along the periphery of the dimples and is easy to flow out form the dimples.

Accordingly, in a preferred embodiment of the present invention, a golf ball is provided wherein each spherical land surface corresponding to each polygon face of the inscribed polyhedron (each spherical land surface can be made by projecting from each polygon face of the inscribed polyhedron) is equipped with a flower-like dimple pattern which comprises a plurality of non-circular or petal dimples made of a pair of arcs or lines and extending in a radial fashion from a center to each apexes on the polygon faces of the inscribed polyhedron. The area occupied by the non-circular dimple can be adjusted by addition of one or some auxiliary or subsidiary dimples between the adjacent non-circular petal dimples. Furthermore, in the present invention the regular polyhedron inscribed in the spherical ball body may be selected from the group consisting of a regular tetrahedron, a regular hexahedron, a regular octahedron, a regular dodecahedron, and regular icosahedrons. Alternatively as the polyhedron inscribed in the spherical ball body, some truncated polyhedrons may be selected. The truncated polyhedron can be made by cutting off a part of each apex of a variety of the regular polyhedron including a regular tetrahedron, a regular hexahedron, a regular octahedron, a regular dodecahedron, and regular icosahedrons. The truncated polyhedron provides a variety of faces including a bigger remaining face or a smaller cut face by cutting off a part of each apex of the polyhedron, so that in case of the smaller cut face, a small auxiliary dimple may be formed on the spherical land surface while in case of the bigger remaining face, a non-circular dimple may be formed on the spherical land surface.

In the present invention, the depth of the non-circular dimples is necessary in a same manner of the conventional dimples so as to create turbulent flows by the airflow surrounding the ball. For example the non-circular dimples may be made in the depth range of 0.2 to 0.5 mm.

To sum it up, according to the present invention, the spherical land parts are made according to a concept that the ball spherical surface is divided into a plurality of spherical surface parts with each polygon face of a polyhedron virtually inscribed in the spherical surface of the ball body. On each spherical surface part, some or all of the dimples are formed as a non-circular dimples having a width of more than 1.5 mm and a length of more than 2 times of the width, so that vortices generated in the non-circular dimples do not stay in the dimples and flow along the longitudinal direction of the non-circular dimples and the vertical vortices easily flow out in at least two different directions. The different flows of the vortices causes the vertical vortices generated in the neighboring dimples to interfere with each other, so that all of the vortices totally tend not to stay in the dimples and easy to flow out rearward, resulting in further rearward movement of the separation boundary. In case of insufficient lift power caused by a smaller area occupied by non-circular dimples, it is possible to increase the lift power by making additional circular or polygonal dimples on the remaining land surface parts.

Advantageous Effects of Invention

According to the conventional circular dimples the vortices generated by the dimples tend to stay in the dimples, while according to this inventive non-circular dimples the vortices generated by the non-circular dimples generate with a time difference, so that the vortices tend not to stay in the non-circular dimples and flow easily along the oblong periphery of the non-circular dimples.

BRIEF DESCRIPTION OF DRAWINGS

The present invention will be explained in conjunction with illustrative embodiments shown in the accompanying drawings, in which.

DESCRIPTION OF EMBODIMENTS

Figure 1:
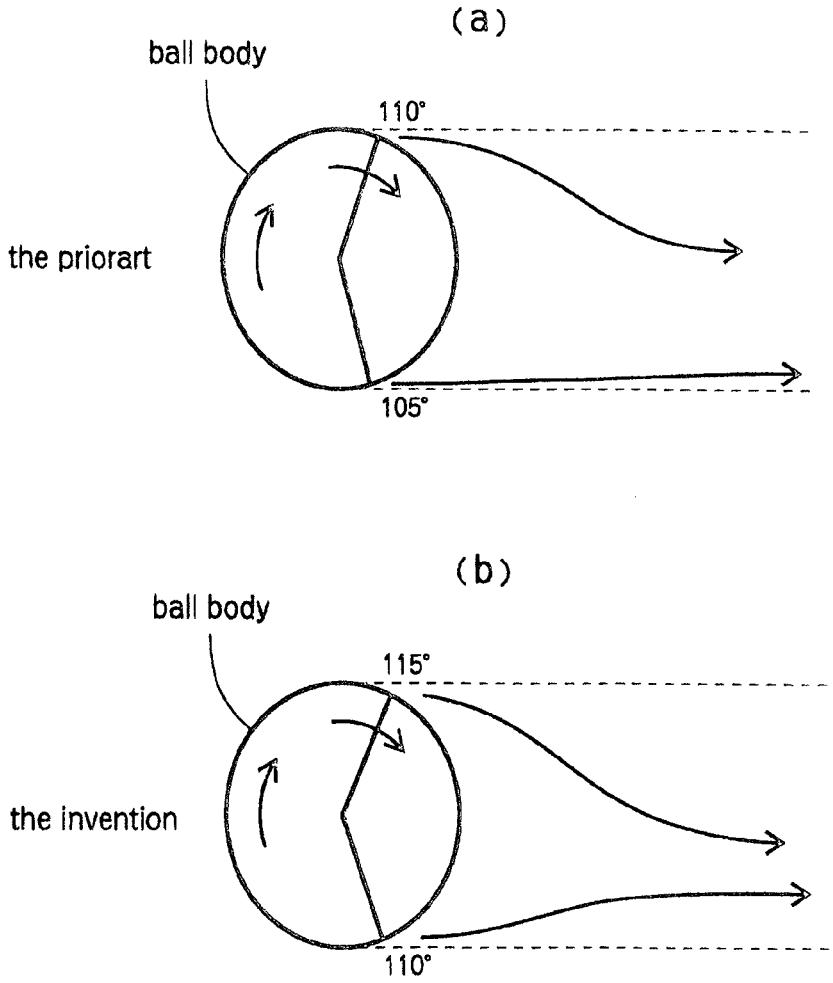
FIGS. 1 (*a*) and (*b*) are function comparative views between the prior art and the present invention, wherein (*a*) shows the prior art function based on the circular dimples and (*b*) shows the present inventive function based on the non-circular dimples.

Hereinafter, the present invention will be explained in detail based on the following embodiments shown in the drawings.

FIG. 2 to FIG. 6 show examples showing how to make the variety of dimple patterns of the golf ball on each face of a polyhedron or a truncated polyhedron inscribed in a spherical ball body. On each of the figures, an outer circle shows a spherical ball body, in which a polyhedron is inscribed virtually or hypothetically so as to divide the total spherical surface into a plurality of spherical land surface parts with each polygon face of a polyhedron inscribed in the spherical ball body. On each spherical land surface part projected from each face of the virtually inscribed polyhedron, non-circular dimples are formed. In the examples of the standard ball size, generally non-circular dimples 2, 12 and 22 are formed so as to increase the depth from the periphery to the center of the spherical land surface within a range of 0.2 to 0.5 mm so that the air surrounding the ball is induced to flow along the longitudinal direction of the non-circular dimples and vertical vortices are generated at the periphery of the dimple when the air flow out from the non-circular dimple. As long as the vertical vortices can be generated, the depth of the dimple may be uniform.

EXAMPLES

FIG. 2 to FIG. 6 explain a method of forming a variety of dimple patterns on each spherical land face of the spherical ball body divided according to a projection method from each face of a polyhedron inscribed in a spherical ball body. At first a regular polyhedron is virtually imaged so as to be inscribed in a ball spherical body and the spherical surface of the ball body is divided into a plurality of spherical land surface parts with each face of the polyhedron inscribed in the spherical ball body.

Example 1

Figure 2:
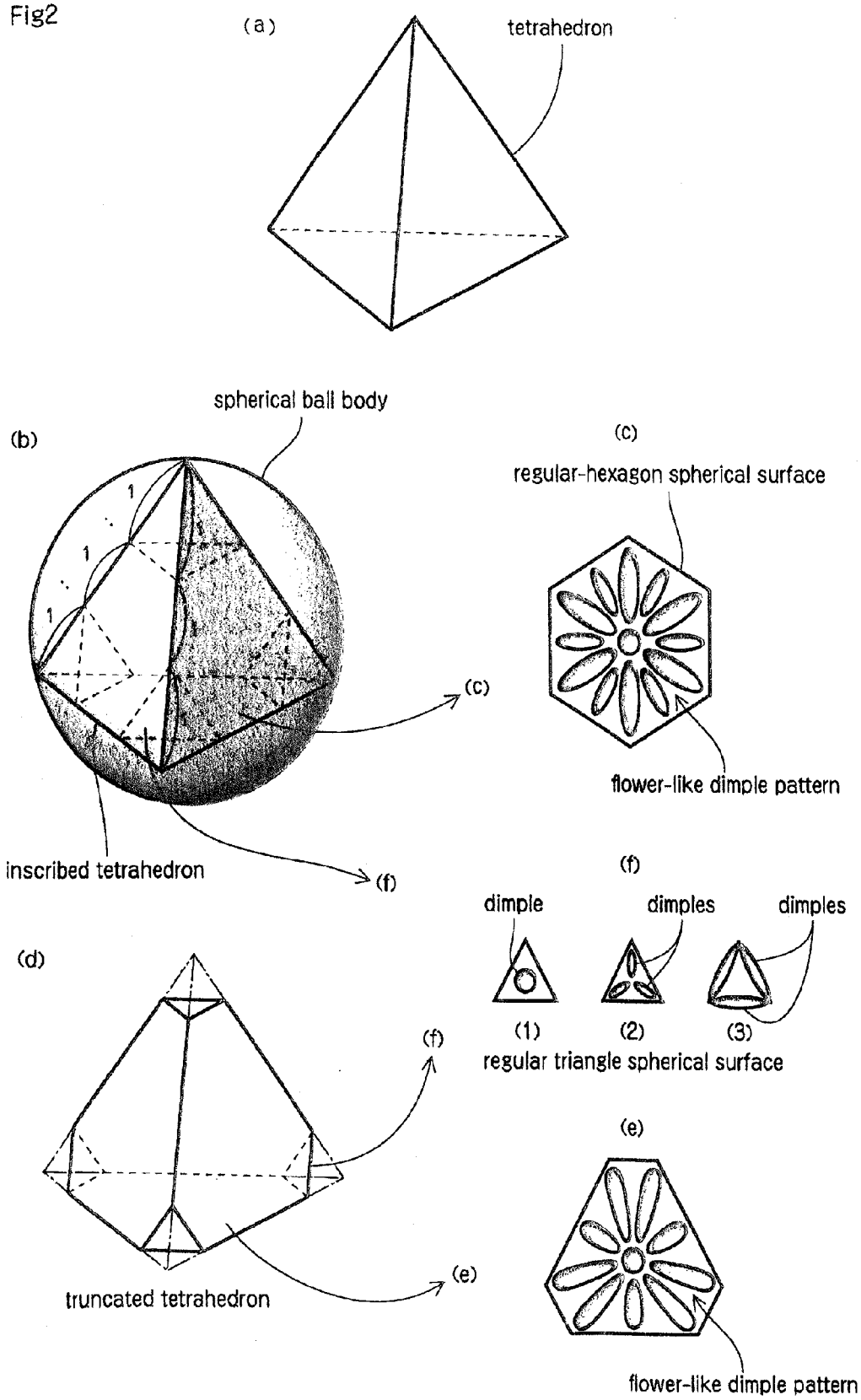
FIG. 2 (*a*) to (*f*) are explanation views for explaining a method of forming a dimple pattern on each spherical land surface divided with each face of a tetrahedron inscribed in a spherical ball body, wherein (*a*) is a perspective view showing a tetrahedron to be inscribed, (*b*) shows an inscribed spherical ball body of the tetrahedron (*a*), (*c*) shows a flower-like dimple pattern on a regular hexagon spherical surface corresponding to one hexagon face made from regular triangle faces of a regular tetrahedron formed by cutting off one-third of each apex so as to divide each ridge line into three shares (1:1:1), (*d*) is a perspective view showing a truncated tetrahedron formed by cutting a part of each apex of the tetrahedron so as to divide each ridge line into (1:3:1), (*e*) shows a flower-like dimple pattern on a hexagon spherical land surface on a spherical ball body projected from the corresponding one hexagon face of the truncated tetrahedron, and (*f*) shows additional dimples on regular triangle spherical faces (1), (2) and (3) on a spherical ball body, projected from the corresponding one of cut faces of the truncated tetrahedron.

(1) Method of Manufacturing a Non-Circular Dimple Pattern on Spherical Land Surfaces of an Inscribed Spherical Ball Body of the Tetrahedron (*a*) as Shown in FIG. 2

FIG. 2 (*a*) is a perspective view showing a tetrahedron to be inscribed in a spherical ball body and FIG. 2 (*b*) shows an inscribed spherical ball body of the tetrahedron (*a*). FIG. 2(*c*) shows a regular hexagon spherical surface provided with a flower-like dimple pattern. The spherical ball body surface is divided into a plurality of regular hexagon spherical surface parts by projecting from one of hexagon faces of a regular truncated tetrahedron which is formed by dividing each ridge line into three shares (1:1:1) and then a flower-like dimple pattern is formed on the spherical surface part (land surface) by petal-shaped dimples (non-circular dimples) extending in a radial fashion. On the other hand, FIG. 2 (*d*) is a perspective view showing a truncated tetrahedron formed by cutting one-fifth of each apex. FIG. 2(*e*) shows a hexagon spherical surface corresponding to one of hexagon faces of the truncated tetrahedron (*d*) inscribed in a ball spherical body, wherein a flower-like dimple pattern comprising petal dimples extending in a radial fashion is provided and FIG. 2(*f*) shows regular triangle truncated faces (1), (2) and (3), wherein (1) shows a circular dimple on a triangle spherical face, (2) shows non-circular petal dimples extending radially to each apex on a triangle spherical face and (3) shows non-circular dimples comprising a pair of arcs enclosing each ridge of the triangle spherical face.

Example 2

Figure 3A:
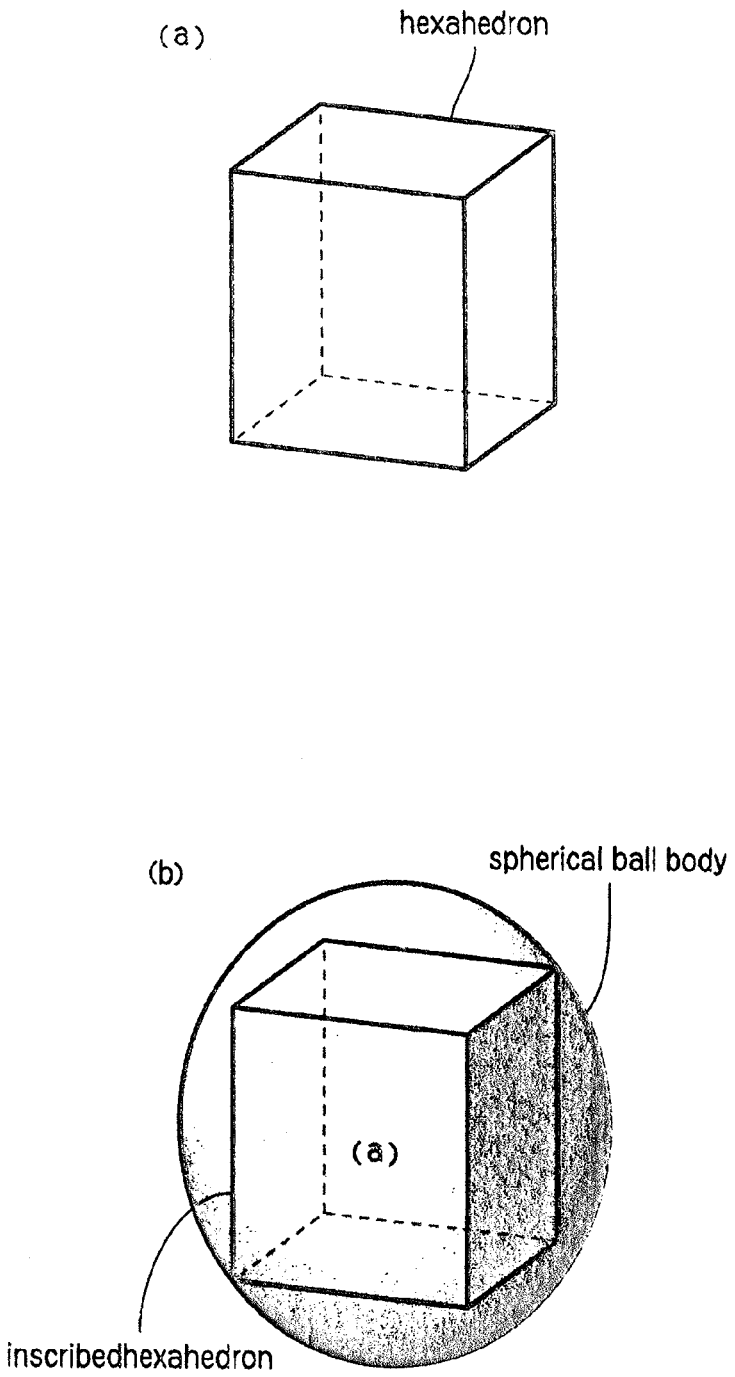
FIG. 3 (*a*) to (*g*) are explanation views for explaining a method of forming a dimple pattern on each spherical land surface projected from each face of a hexahedron inscribed in a spherical ball body, wherein (*a*) is a perspective view showing a hexahedron to be inscribed in a spherical ball body, (*b*) shows an inscribed spherical ball body of the hexahedron (*a*), (*c*) shows a truncated hexahedron formed by cutting off a part of each apex of the hexahedron, (*d*) shows a flower-like dimple pattern on an octagon spherical land surface, projected from the corresponding one of cut remaining faces of the truncated hexahedron (*c*), (*e*) shows dimple patterns on triangle spherical faces with different additional dimples (1), (2) and (3) projected from the corresponding one of horizontal cut faces of the truncated hexahedron (*c*), (*f*) shows a regular truncated hexahedron by cutting off one-second of each apex so as to divide the ridge lines into two shares(1:1), (*g*) shows a small flower-like dimple pattern on a regular triangle spherical land surface, projected from the corresponding one of triangle cut faces of the truncated tetrahedron (*f*), and (*h*) shows a larger flower-like dimple pattern on a regular tetragon spherical surface, projected from the corresponding one of cut remaining tetragon faces of a regular truncated tetrahedron (*f*)
Figure 3B:
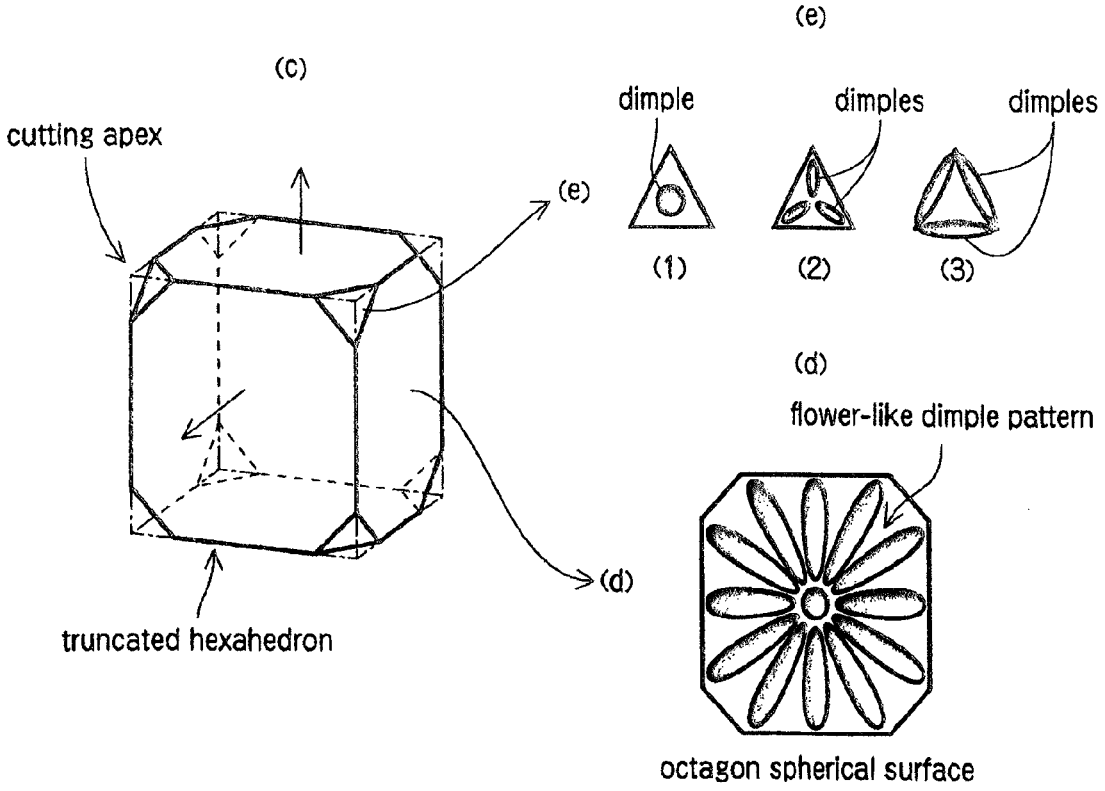
Figure 3C:
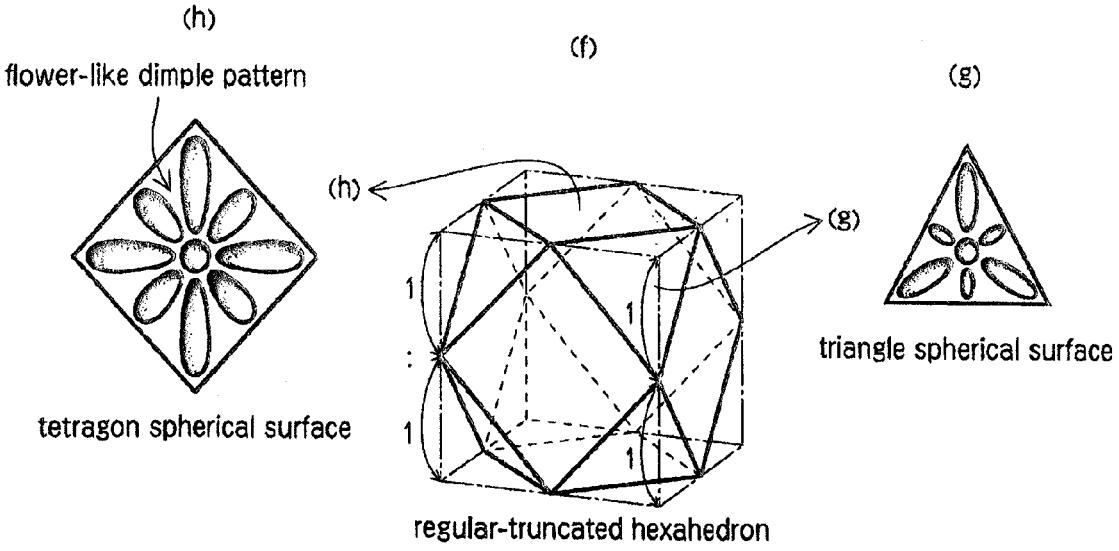

(2) Method of Manufacturing a Non-Circular Dimple Pattern on Spherical Land Surfaces of an Inscribed Spherical Ball Body of the Hexahedron (*a*) as Shown in FIG. 3

FIG. 3 (*a*) is a perspective view showing a hexahedron to be inscribed in a spherical ball body and FIG. 3(*b*) shows an inscribed spherical ball body of the hexahedron (*a*), while FIG. 3(*c*) shows a truncated hexahedron comprising octagons and triangles formed by cutting one-fifth of each apex of the hexahedron (*a*), and FIG. 3(*d*) shows a dimple pattern on an octagon spherical surface corresponding to one of octagon faces of the truncated hexahedron (*c*). FIG. 3 (*e*) shows a dimple pattern on triangle faces with different additional dimples (1), (2) and (3) corresponding to one of cut faces of the truncated hexahedron, wherein (1) shows a circular dimple on a triangle spherical face, (2) shows non-circular petal dimples extending radially to each apexes on a triangle spherical face and (3) shows non-circular dimples comprising a pair of arcs enclosing each ridge of the triangle spherical face. FIG. 3 (*f*) shows a regular truncated hexahedron comprising triangles (*g*) and tetragons (*h*) by dividing the ridge lines into two shares (1:1). FIG. 3 (*g*) shows a regular triangle spherical face (land surface) with a flower-like dimple pattern corresponding to one of cut faces of the truncated tetrahedron, while FIG. 3 (*h*) shows a regular tetragon spherical surface (land surface) corresponding to one of the remaining faces of a regular truncated tetrahedron, wherein a flower-like dimple pattern is formed by petal dimples (non-circular dimples) extending in a radial fashion from the center to the periphery on the tetragon spherical surface.

Example 3

Figure 4A:
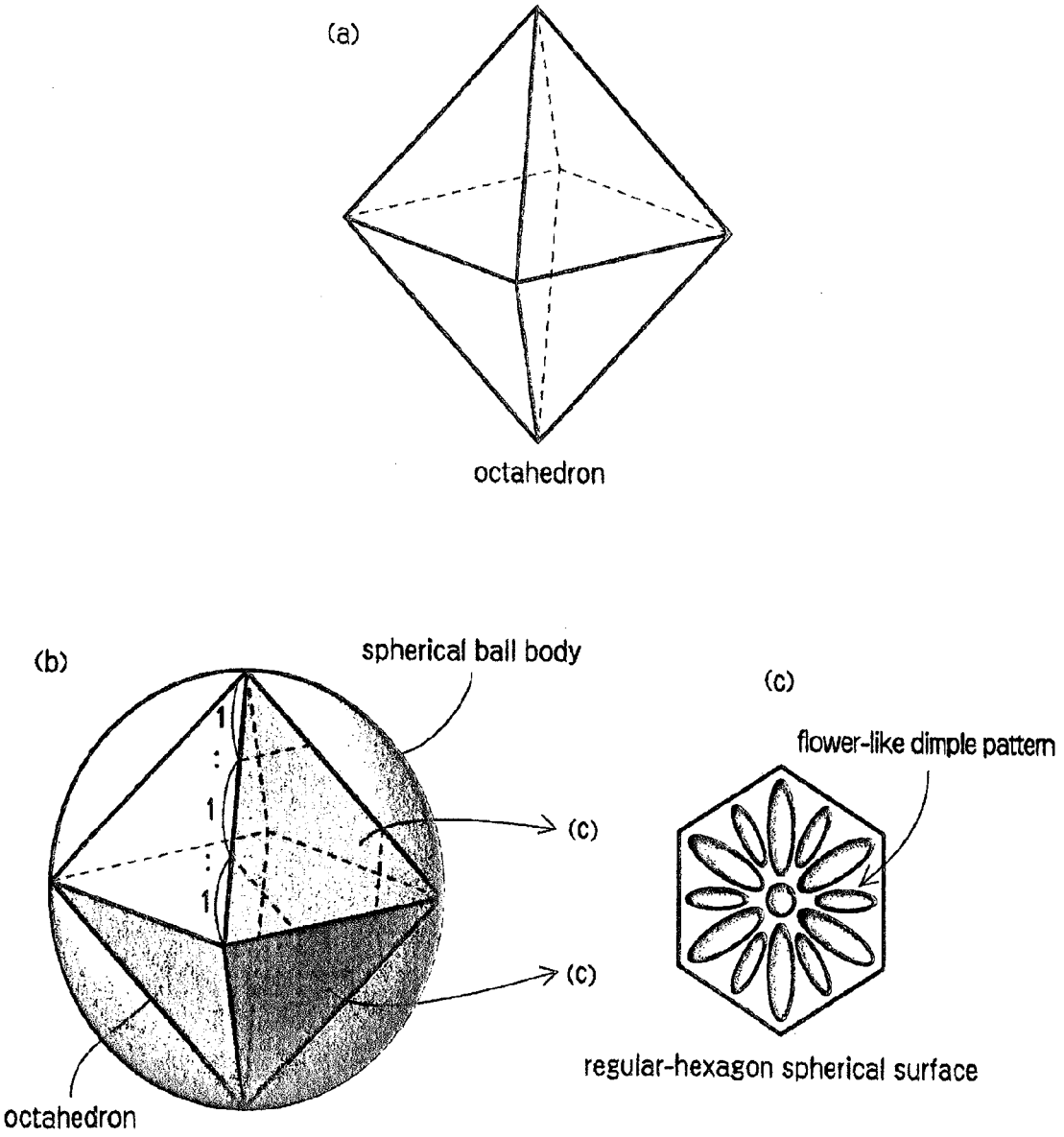
FIG. 4 (*a*) to (*f*) are explanation views for explaining a method of forming a dimple pattern on each spherical land surface projected from each face of an octahedron inscribed in a spherical ball body, wherein (*a*) is a perspective view showing an octahedron to be inscribed, (*b*) shows an inscribed spherical ball body of the octahedron (*a*), (*c*) shows a flower-like dimple pattern on a regular hexagon spherical surface of the spherical ball body projected from the corresponding one of cut hexagon faces of a regular octahedron formed by dividing each ridge line into three shares(1:1:1), (*d*) shows a perspective view showing a truncated octahedron to be inscribed, (*e*) shows a flower-like dimple pattern on a hexagon spherical surface, projected from the corresponding one of the remaining hexagon faces of the truncated octahedron (*d*) inscribed in a ball spherical body, and (*f*) shows a regular tetragon face with different additional dimples (1), (2) and (3), projected from the corresponding to one of the tetragon cut faces of the truncated octahedron (*d*)
Figure 4B:
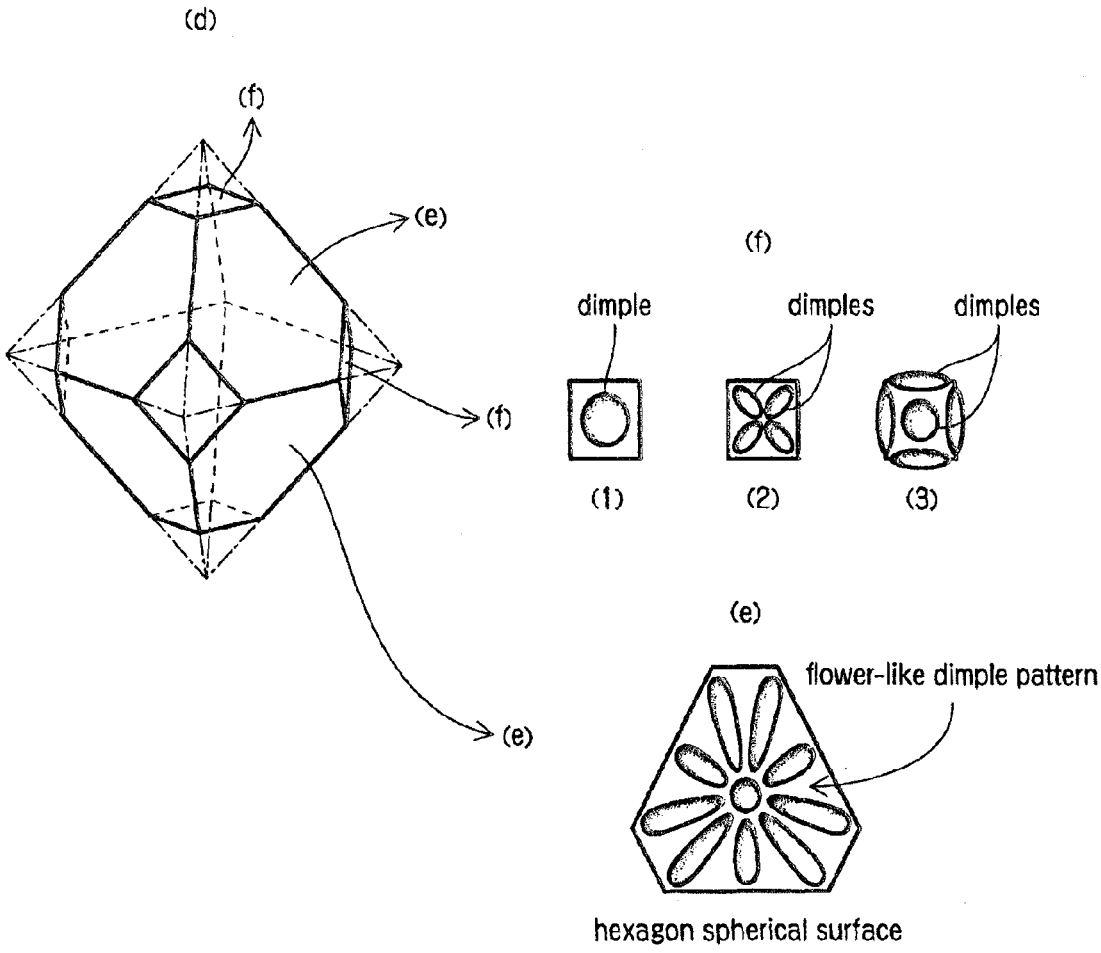

(3) Method of Manufacturing a Non-Circular Dimple Pattern on Spherical Land Surfaces of an Inscribed Spherical Ball Body of the Octahedron (*a*) as Shown in FIG. 4

FIG. 4 (*a*) is a perspective view showing an octahedron to be inscribed in a spherical ball body and FIG. 4 (*b*) shows an inscribed spherical ball body of the octahedron (*a*). FIG. 4 (*c*) shows a regular hexagon spherical surface corresponding to one of faces of a regular truncated octahedron formed by dividing each ridge line into three shares (1:1:1), while FIG. 4 (*d*) is a perspective view showing another truncated octahedron. FIG. 4 (*f*) shows regular tetragon faces with different additional dimples (1), (2) and (3) corresponding to one of cut faces of the truncated octahedron, wherein (1) shows a circular dimple on a tetragon spherical face, (2) shows non-circular petal dimples extending radially on a tetragon spherical face and (3) shows non-circular dimples comprising a pair of arcs enclosing each ridges of tetragon, while FIG. 4 (*e*) shows a hexagon spherical surface with a flower-like dimple pattern corresponding to one of hexagon faces of the truncated octahedron inscribed in a ball spherical body.

Example 4

Figure 5A:
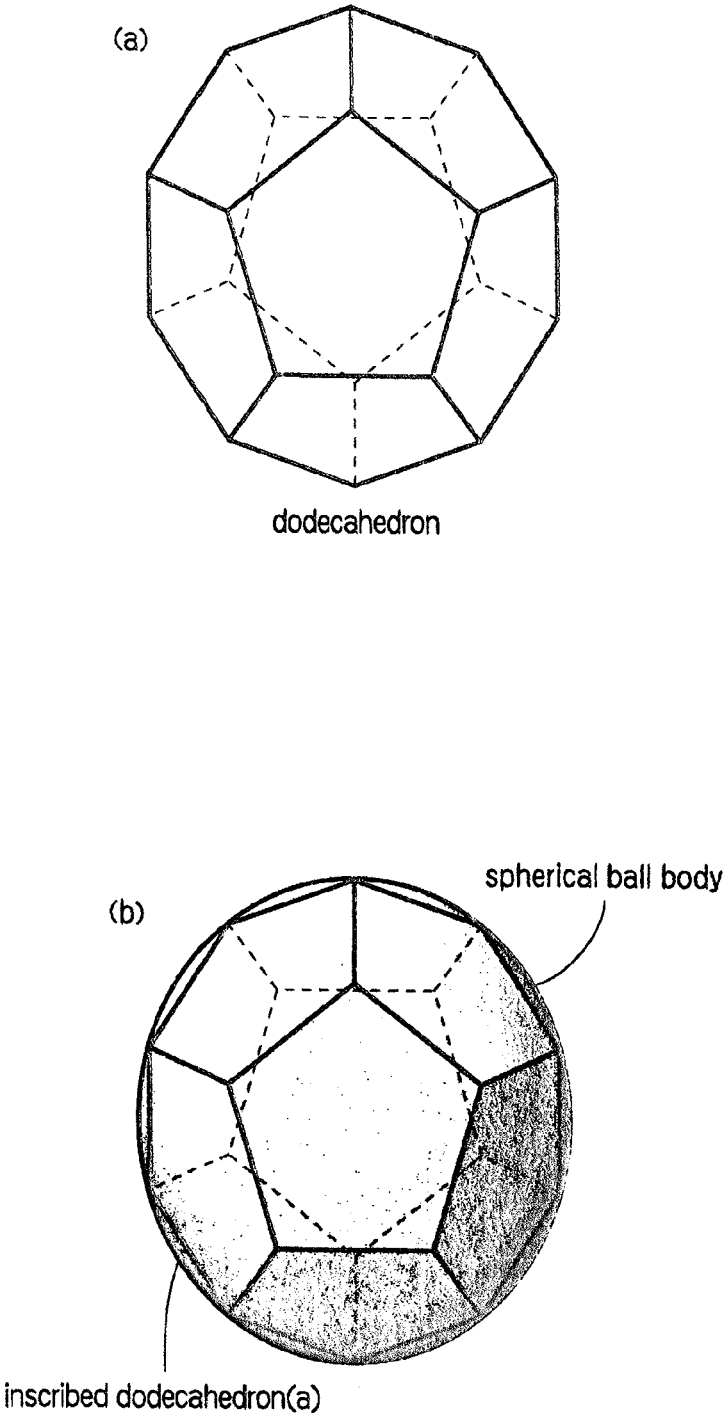
FIG. 5 (*a*) to (*h*) are explanation views for explaining a method of forming a dimple pattern on each spherical land surface projected from each pentagon-shaped face of a dodecahedron inscribed in a spherical ball body, wherein (*a*) is a perspective view showing a dodecahedron to be inscribed in a spherical ball body, (*b*) shows an inscribed spherical ball body of the dodecahedron (*a*), (*c*) shows a truncated dodecahedron formed by cutting off a part of each apex of the dodecahedron (*a*), (*d*) shows a flower-like dimple pattern (1) on a decagon spherical surface projected from the corresponding one of decagon faces of the truncated dodecahedron (*c*); (*e*) shows a dimple pattern on triangle faces with different additional dimples (1), (2) and (3), projected from the corresponding one of triangle cut faces of the truncated dodecahedron (*c*), shows a regular truncated dodecahedron by cutting off one-second of each apex so as to divide the ridge lines into two shares(1:1), (*g*) shows a flower-like dimple pattern (3) on a regular pentagon spherical surface projected from the corresponding one of the remaining pentagon faces of the truncated tetrahedron (*f*), and (*h*) shows a different flower-like dimple pattern (2) on a regular triangle face projected from the corresponding one of cut triangle faces of the truncated dodecahedron (*f*)
Figure 5B:
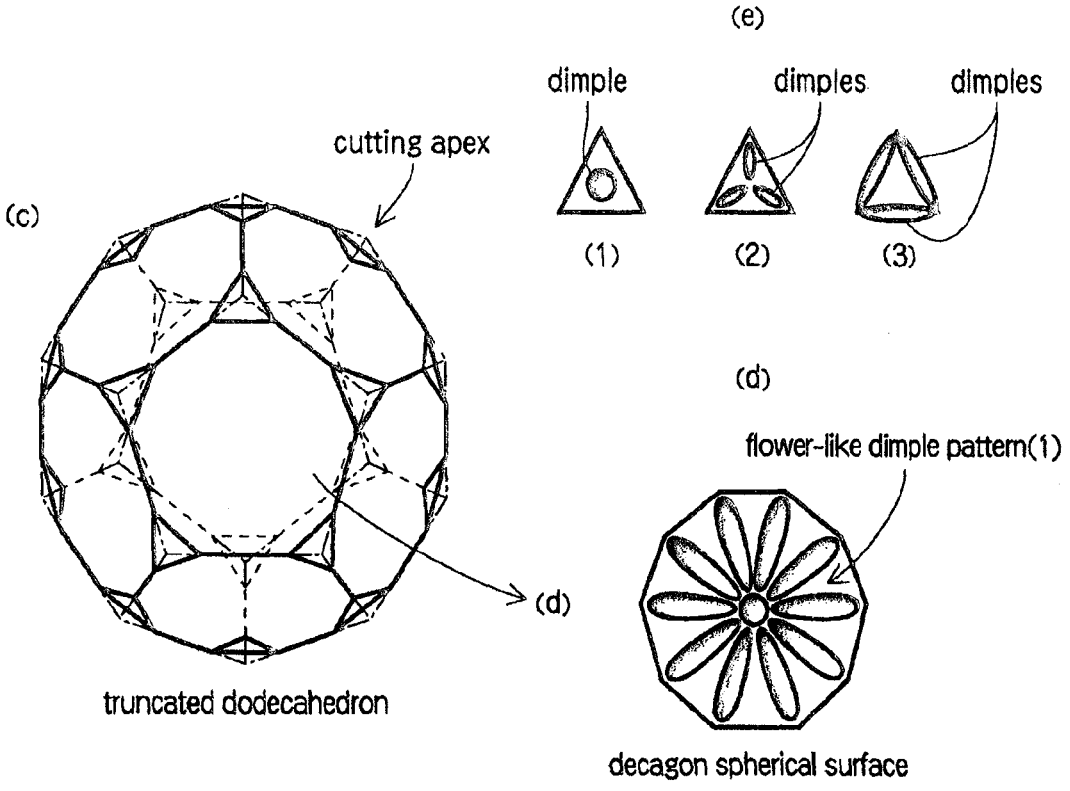
Figure 5C:
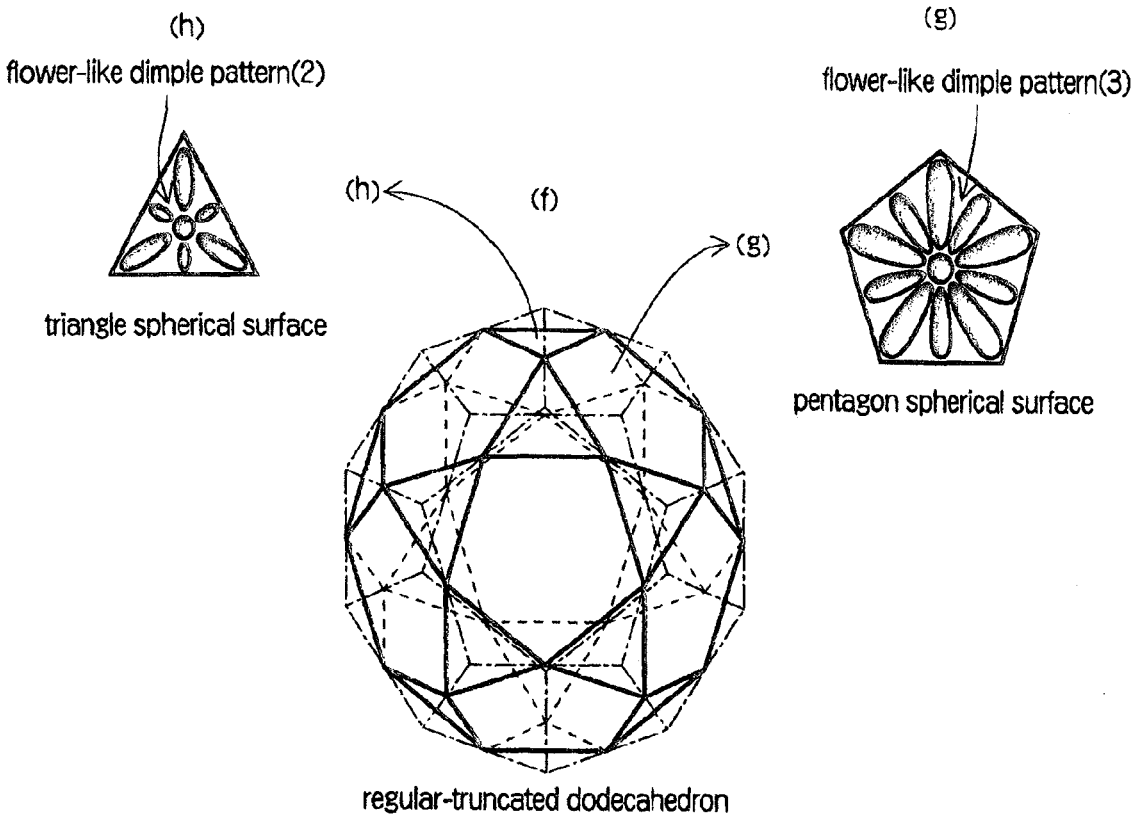

(4) Method of Manufacturing a Non-Circular Dimple Pattern on Spherical Land Surfaces of an Inscribed Spherical Ball Body of the Dodecahedron (*a*) as Shown in FIG. 5

FIG. 5 (*a*) is a perspective view showing a dodecahedron to be inscribed in a spherical ball body and FIG. 5 (*b*) shows an inscribed spherical ball body of the dodecahedron (*a*). FIG. 5 (*c*) shows a truncated dodecahedron formed by cutting one-fourth of each apex of a dodecahedron to be inscribed in a spherical ball body, and FIG. 5(*d*) shows a flower-like dimple pattern (1) on a decagon spherical surface corresponding to one of decagon faces of the truncated dodecahedron (*c*). FIG. 5 (*e*) shows a dimple pattern on triangle faces with different additional dimples (1), (2) and (3) corresponding to one of cut triangle faces of the truncated dodecahedron, wherein (1) shows a circular dimple on a triangle spherical face, (2) shows non-circular petal dimples extending radially to each apex on a triangle spherical face and (3) shows non-circular dimples comprising a pair of arcs enclosing each ridges of a triangle spherical face. On the other hand, FIG. 5 (*f*) shows a regular truncated dodecahedron by dividing the ridge lines into two shares (1:1), and FIG. 5 (*g*) shows a regular pentagon spherical face (land surface) with a flower-like dimple pattern (3) corresponding to one of the remaining faces of the truncated tetrahedron, while FIG. 5 (*h*) shows a regular triangle face with a different flower-like dimple pattern (2) corresponding to one of cut faces of the truncated dodecahedron.

Example 5

Figure 6A:
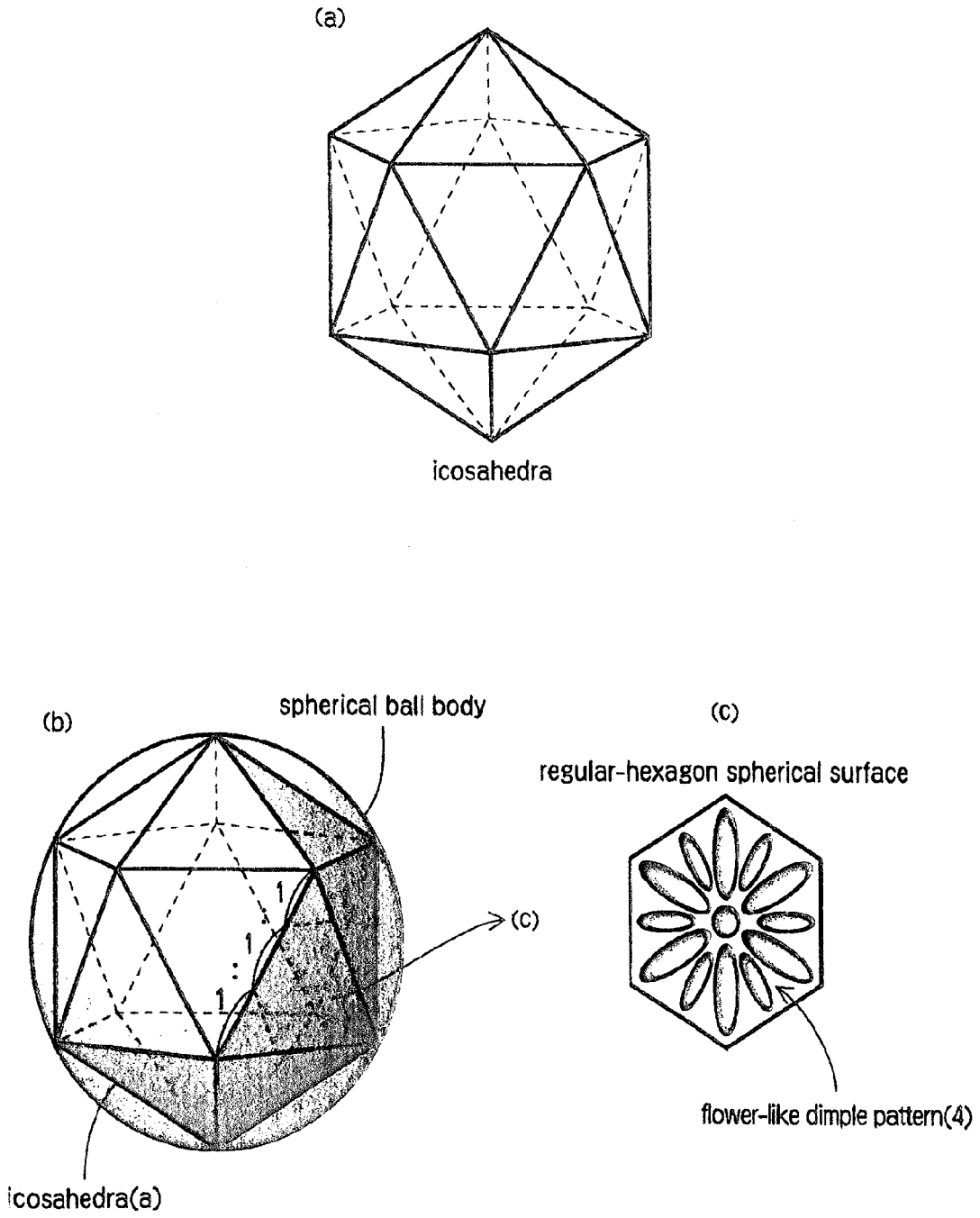
FIG. 6 (*a*) to (*f*) are explanation views for explaining a method of forming a dimple pattern on each triangle-shaped spherical face projected from each face of an icosahedra inscribed in a spherical ball body, wherein (*a*) is a perspective view showing an icosahedra to be inscribed in a spherical ball body, (*b*) shows an inscribed spherical ball body of the icosahedra (*a*), (*c*) shows a dimple pattern on a regular hexagon spherical surface of a truncated icosahedra formed by cutting off one-third of each apex so as to divide the ridge lines into three shares(1:1:1), (*d*) shows a truncated icosahedra formed by cutting off one-fifth of each apex of icosahedra (*a*) so as to divide the ridge lines into three shares (1:3:1), (*e*) shows a flower-like dimple pattern (6) on hexagon spherical surfaces projected from the corresponding one of the remaining faces of the truncated dodecahedron (*d*), and (*f*) shows a flower-like dimple pattern (5) on a regular pentagon spherical surface projected from the corresponding one of cut faces of the truncated tetrahedron (*d*)
Figure 6B:
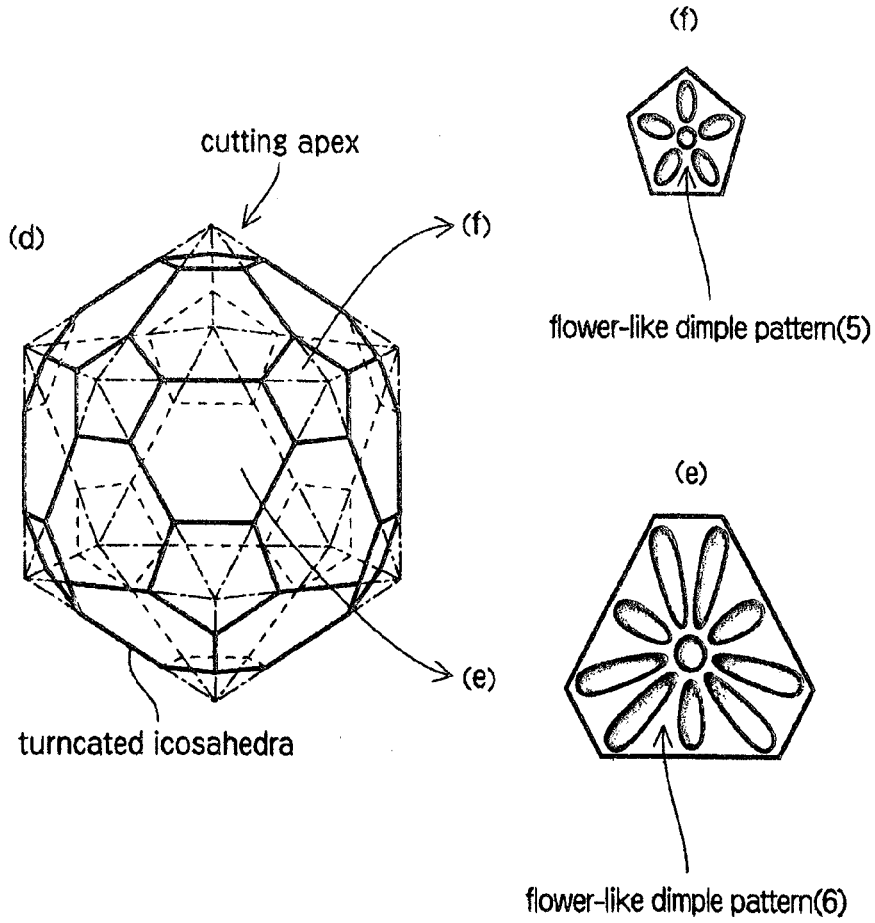

(5) Method of Manufacturing a Non-Circular Dimple Pattern on Spherical Land Surfaces of an Inscribed Spherical Ball Body of the Icosahedra (*a*) as Shown in FIG. 6

FIG. 6(*a*) is a perspective view showing icosahedra to be inscribed in a spherical ball body and FIG. 6 (*b*) shows an inscribed spherical ball body of the icosahedra (*a*). FIG. 6 (*c*) shows a flower-like dimple pattern (4) made of petal dimples extending in a radial fashion on a regular hexagon spherical surface formed by cutting one-third of each apex so as to divide the ridge lines into three shares (1:1:1) of the inscribed icosahedra (*a*), while FIG. 6(*d*) shows a truncated icosahedra comprising hexagons (*e*) and pentagons (*f*) formed by cutting one-fifth of each apex of icosahedra (*a*) so as to divide the ridge lines into three shares (1:3:1). FIG. 6 (*e*) shows a flower-like dimple pattern (5) made of petal dimples extending in a radial fashion on hexagon spherical faces (land surfaces) corresponding to one of the remaining faces of the truncated dodecahedron (*d*), and FIG. 6 (*g*) shows a regular pentagon face (land surface) with a flower-like dimple pattern (6) made of petal dimples extending in a radial fashion corresponding to one of the cut faces of the truncated tetrahedron (*d*).

In the above examples, on the regular polyhedron spherical surface there are provided a dimple pattern comprising oval or non-circular dimples made of a pair of arcs combined in a closed fashion according to a concept that a turbulent flow is generated with a time difference at the periphery of the non-circular dimples and flow the resultant vortices along the arc periphery. The skill in the art can modify or arrange the dimple pattern described above into other dimple patterns within the concept of the present invention. For example, the present invention is to make a dimple pattern on the basis of the concept that the vertical vortices generated at the periphery of the dimples is made to flow out easily from the dimple and to move rearward.

Figure 10:
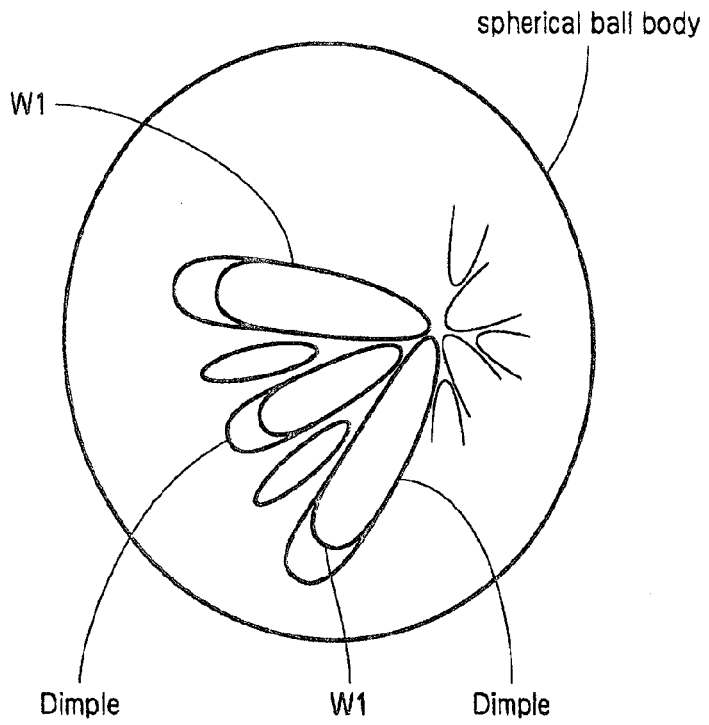
FIG. 10 is a plain view of the first example of non-circular dimples on the spherical land surfaces of the spherical ball body, in case that the length is more than 2 times of the width.
Figure 11:
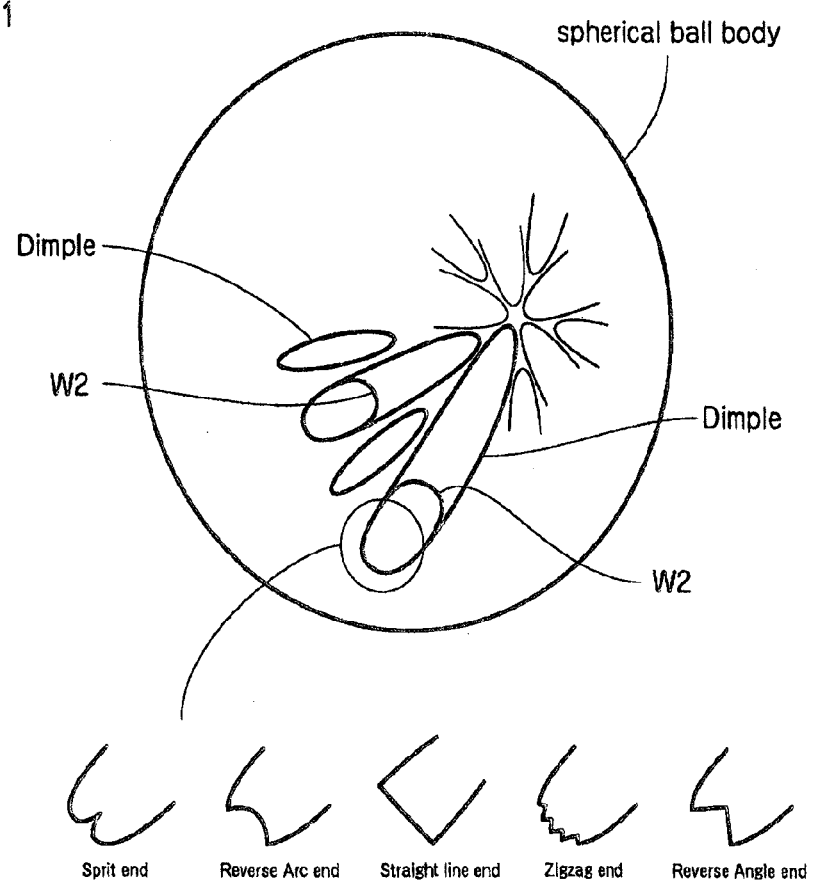
FIG. 11 is a plain view of the second example of non-circular dimples on the spherical land surfaces of the ball spherical body, in case that the length is more than 2 times of the width, wherein (1) shows a split arc end type of the non-circular dimple. (2) shows a reverse arc end type of the non-circular dimple, (3) shows a direct line end type of the non-circular dimple, (4) shows a zigzag end type of the non-circular dimple and (5) shows a reverse angle V end type of the non-circular dimple.
Figure 12:
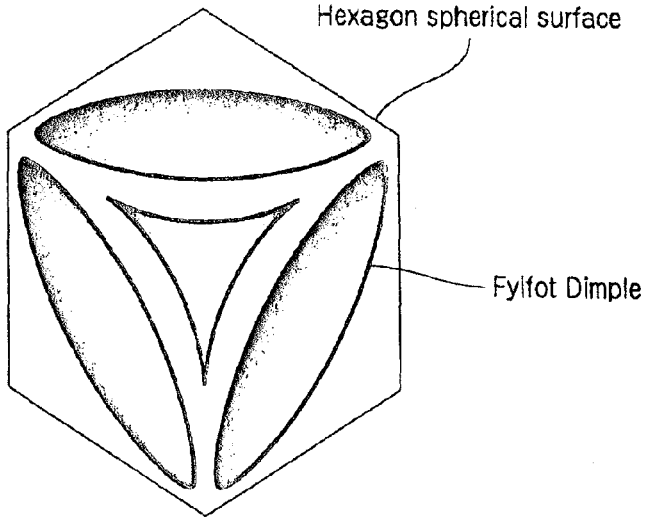
FIG. 12 are plain views of other dimple patterns on hexagon spherical faces, wherein (*a*) shows a dimple pattern of a fylfot dimple pattern provided with three non-circular dimples made of a pair of arcs on a hexagon face, (*b*) shows a dimple pattern of combination of long rectangular dimples and short rectangular dimples arranged in a radial fashion and (*c*) shows a dimple pattern consisting of 7 double ring dimples, wherein 1, 11 21 in all of the figures denote spherical ball bodies and 2, 12 and 22 denote oval non-circular dimples on the spherical land surfaces.
Figure 12:
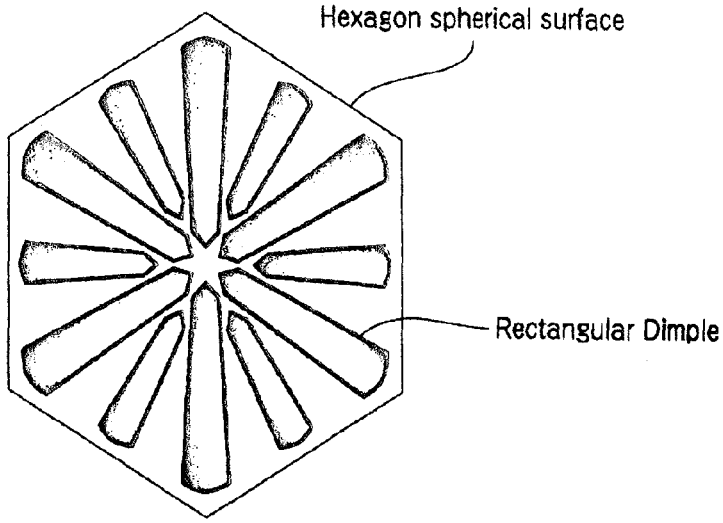
Figure 12:
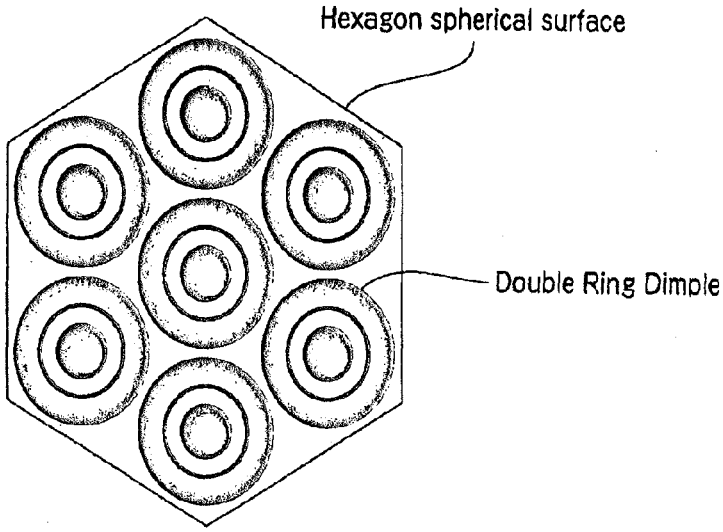

According to the inventive concept, it may be desired that the longitudinal length of the dimple is more than 2 times (4 mm) of the width of the dimple. FIG. 10 is a perspective view of the first example of non-circular dimples on the spherical land surfaces of the spherical ball body, in case that the length is more than 2 times of the width. In case that the length of the dimple is more than 2 times of the width as shown in FIG. 10, it is preferred to form a tripping wall W1 at the middle of the dimple. Although the middle tripping wall is preferred to be formed in an arc fashion as shown in FIG. 10, it may be formed in a reverse arc fashion W2 as shown in FIG. 11. On the other hand, the longitudinal end of the dimple can be adopted so as to be selected form the group consisting of a split end, a reverse arc end, a straight line end, a zigzag end and a reverse angle V end and so on as shown in FIG. 11. Furthermore, although the above examples were explained by using the flower-like dimple pattern extending in a radial fashion, it is essential to make vortex to flow in at least two different directions. Therefore, according to the present invention, as long as the longitudinal length of the dimple is more than 2 times of the width, a variety of the dimple patterns can be selected as shown in FIGS. 12 (*a*), (*b*) and (*c*), wherein (*a*) shows a fylfot shaped dimple pattern on the hexagon spherical surface, (*b*) shows a dimple pattern consisting of rectangular-like dimples made of a pair of straight lines extending in a radial fashion on the hexagon spherical surface, and (*c*) shows a dimple pattern consisting of 7 double ring dimples constructed by a center circular dimple and a outer ring dimple uniformly distributed on the hexagon spherical surface.

Further, since this invention relates to the spherical cover parts of the golf ball, it is needless to say that the concept of the present invention can be applied to golf balls provided with a variety of the internal structure such as multi-piece ball including not only 2 piece and 3 piece-ball but also 4 piece ball.

Figure 7:
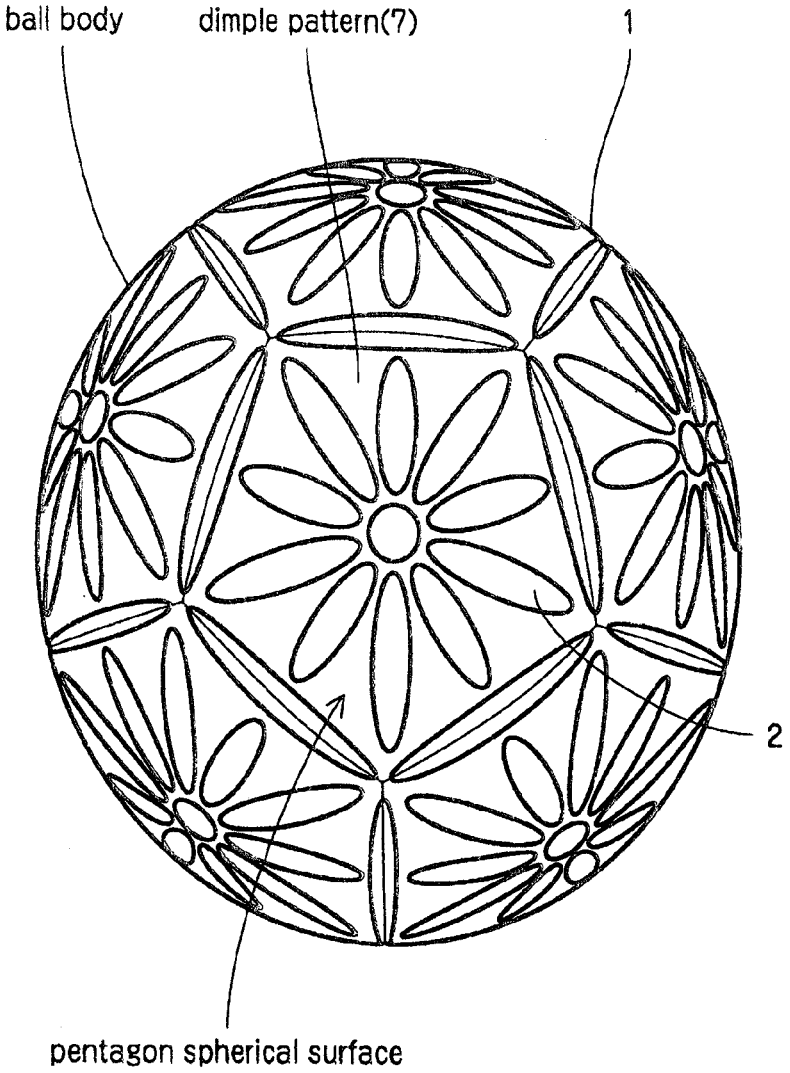
FIG. 7 is a perspective view of a golf ball provided with a dimple pattern (7) on each spherical pentagon land surface, which comprises a flower-like dimples on each pentagon land surface and non-circular dimples on the ridge lines of each pentagon spherical land surface, which is made by projecting from each pentagon face of a dodecahedron inscribed in a spherical ball body.
Figure 8:
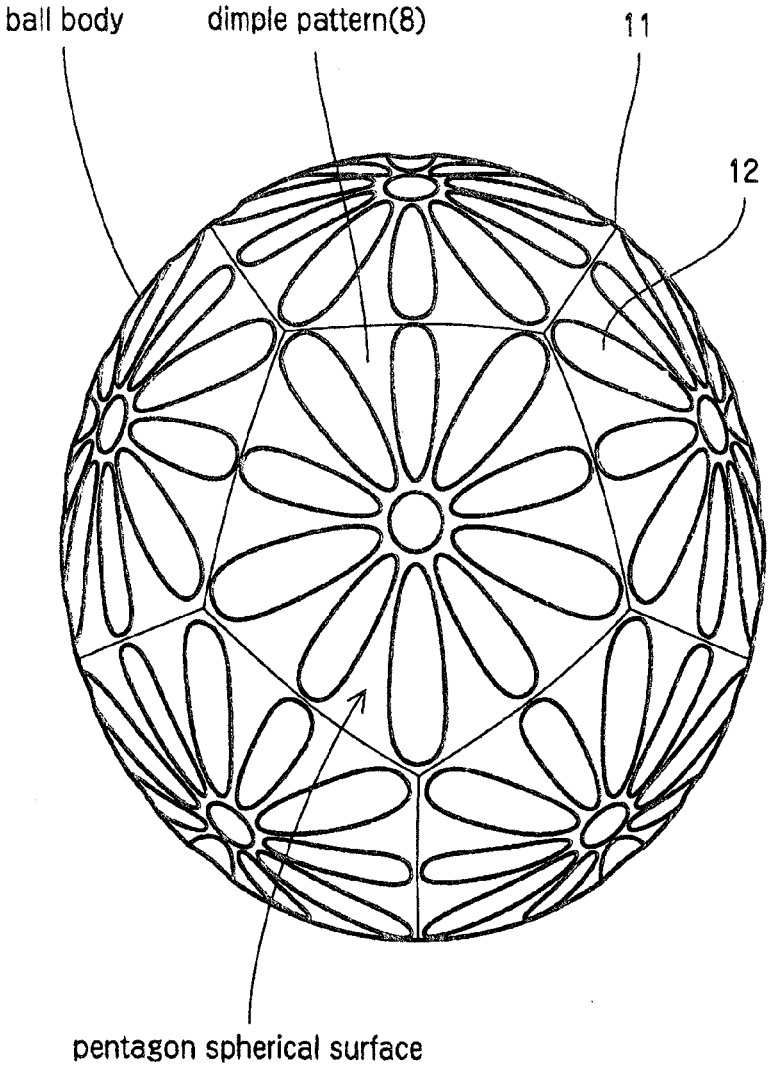
FIG. 8 is a perspective view of a golf ball provided with a flower-like dimple pattern (8) on each pentagon spherical land surface, which is made by projecting from each pentagon face of a dodecahedron inscribed in a spherical ball body.
Figure 9:
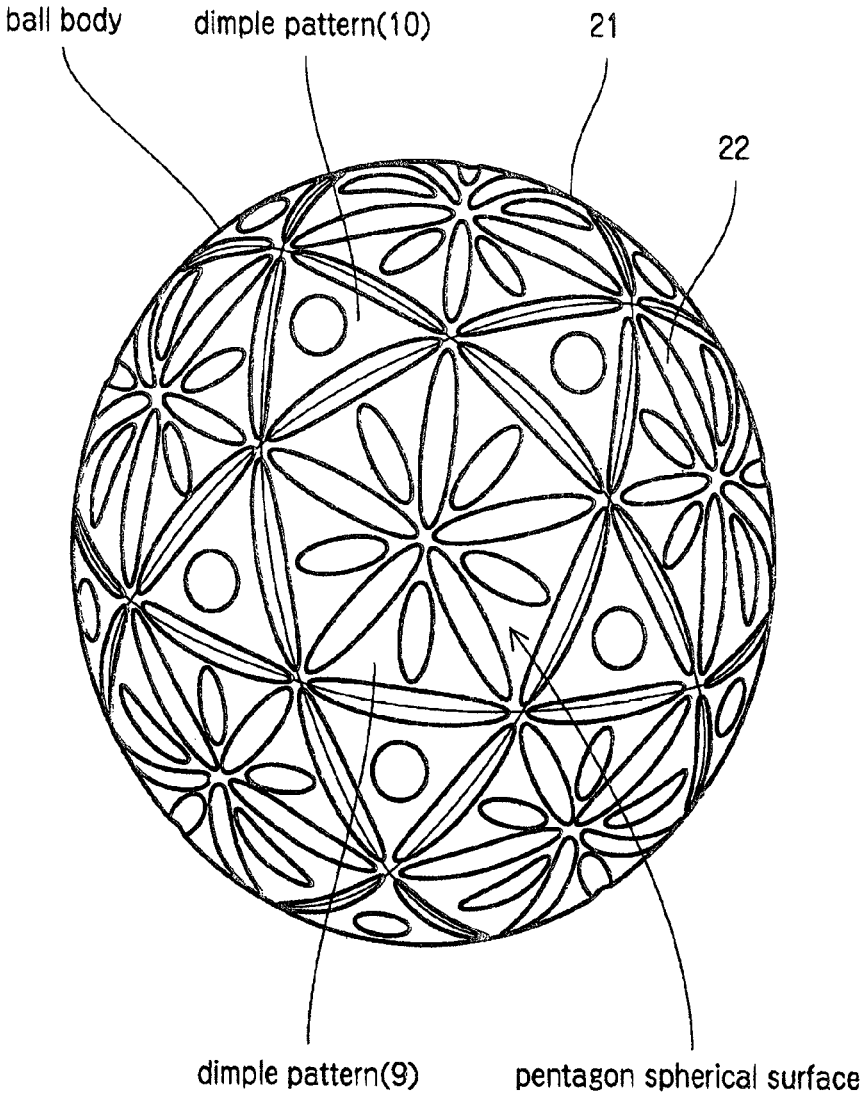
FIG. 9 is a perspective view of a golf ball provided with pentagon flower-like dimple patterns (9) on spherical pentagon land surfaces and triangle dimple patterns (10) on spherical triangle land surfaces, which are made by projecting from each pentagon and triangle cut face of a truncated dodecahedron inscribed in a ball spherical body, wherein the pentagon flower-like dimple pattern (9) is arranged on the pentagon land faces and provided with non-circular dimples formed on the ridge lines of the pentagon faces and the triangle flower-like dimple pattern (10) is arranged on the triangle land faces and provided with non-circular dimples formed on the ridge lines of the triangle faces.

FIG. 7 to FIG. 9 are perspective views showing a variety of outer dimple patterns of the golf balls actually manufactured. That is, FIG. 7 is a perspective view of a golf ball provided with a dimple pattern (7) comprising a flower-like dimples extending in a radial fashion on each land surface and non-circular dimples made of a pair of arcs extending along the ridge lines from one apex to another apex of each pentagon spherical land surface, which are projected from each pentagon face of a regular dodecahedron inscribed in a spherical ball body. FIG. 8 is a modified example from FIG. 7 and shows a perspective view of a golf ball provided with a flower-like dimple pattern (8) comprising a flower-like dimples extending in a radial fashion on each land surface, which are projected from each pentagon face of a regular dodecahedron inscribed in a spherical ball body, while non-circular dimples made of a pair of arcs extending on the ridge lines from one apex to another apex of each pentagon spherical land surface are not formed. On the other hand, FIG. 9 is another modified example based on a truncated dodecahedron made by cutting off each apex different from FIG. 7 of the dodecahedron inscribed in a spherical ball body and shows a perspective view of a golf ball provided with pentagon flower-like dimple patterns (9) on the pentagon land surfaces and triangle dimple patterns (10) on the triangle land surfaces, which is made on a spherical ball surface by projecting from each pentagon and triangle cut face of a truncated dodecahedron inscribed in a ball spherical body. The pentagon flower-like dimple pattern (9) is arranged on the pentagon land faces and is provided with non-circular dimples formed on the ridge lines of the pentagon faces, and the triangle flower-like dimple pattern (10) is provided with non-circular dimples formed on the ridge lines of the triangle faces, wherein the flower-like dimple is formed on each pentagon spherical land surface projected from pentagon faces of a truncated dodecahedron inscribed in a spherical ball body and the non-circular dimples are made of a pair of arc lines extending along the ridge line of each triangle face and the non-circular dimples are made of a pair of arc lines extending at both sides along the ridge lines.

The invention claimed is:

1. A golf ball comprising:

a spherical ball body having a spherical land surface; and a dimple pattern of a plurality of dimples distributed on the spherical land surface, wherein a regular polyhedron having polygon faces is virtually inscribed in the spherical ball body, and the spherical land surface is divided into a plurality of identical spherical land surface parts by means of the polygon faces of the regular polyhedron, respectively, wherein on each spherical land surface part, almost all of the dimples are formed as non-circular dimples having a width of more than 1.5 mm but not more than 2.5 mm, and having a length of more than 2 times the width, wherein on each spherical land surface part, the non-circular dimples comprise a plurality of petal shaped dimples constructed of a pair of arc lines extending radially from the center of the spherical land surface part, and disposed so as to make vortices generated in the dimples flow out in at least two different directions.

2. The golf ball according to claim 1, wherein the spherical land surface parts neighbor each other along ridge lines, wherein the dimple pattern comprises a flower-like petal shape in each of the spherical land surface parts, and supplemental non-circular dimples are disposed so as to extend along each ridge line.

3. The golf ball according to claim 1, wherein the polyhedron is a truncated polyhedron provided with cut faces made by horizontally cutting off a part of each apex of the polyhedron.

4. The golf ball according to claim 3, wherein the spherical land surface parts correspond to the faces of the truncated polyhedron, wherein the spherical land surface parts neighbor each other along ridge lines, and wherein the dimple pattern includes supplemental non-circular dimples disposed so as to extend along each ridge line.

5. The golf ball according to claim 1, wherein the length of the non-circular dimples is 3.5 to 4.5 mm.

6. The golf ball according to claim 1, wherein the length of the non-circular dimples is more than 3.0 mm, and the non-circular dimples are provided with a tripping wall at a distance longer than the width apart from the center of the non-circular dimples.

7. The golf ball according to claim 1, wherein the polyhedron inscribed in the spherical ball body is selected from the group consisting of a regular tetrahedron, a regular hexahedron, a regular octahedron, a regular dodecahedron, and regular icosahedrons.

8. The golf ball according to claim 1, wherein the polyhedron inscribed in the spherical ball body is a truncated polyhedron selected from the group consisting of a truncated tetrahedron, a truncated hexahedron, a truncated octahedron, a truncated dodecahedron, and truncated icosahedrons, the truncated polyhedron being made by horizontally cutting off a part of each apex of the corresponding regular polyhedron.

9. The golf ball according to claim 1, wherein each spherical land surface part includes no more than one circular dimple.

* * * * *